US007841349B2

(12) United States Patent
Bennett

(10) Patent No.: US 7,841,349 B2
(45) Date of Patent: Nov. 30, 2010

(54) LOOSE POWDER COMPACT

(75) Inventor: Kyle Michael Bennett, Brown Deer, WI (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 655 days.

(21) Appl. No.: 11/705,554

(22) Filed: Feb. 12, 2007

(65) Prior Publication Data

US 2008/0190444 A1 Aug. 14, 2008

(51) Int. Cl.
*A45D 33/02* (2006.01)
*A45D 33/00* (2006.01)

(52) U.S. Cl. ..... 132/306; 132/307; 132/293

(58) Field of Classification Search ..... 132/305–307, 132/293–298
See application file for complete search history.

(56) References Cited

U.S. PATENT DOCUMENTS

| | | | | | |
|---|---|---|---|---|---|
| 1,156,456 | A | | 10/1915 | Beck | |
| 1,389,288 | A | | 8/1921 | Beauchamp | |
| 1,416,503 | A | * | 5/1922 | Peacock | 401/121 |
| 1,520,036 | A | | 12/1924 | Sweaf | |
| 1,562,455 | A | * | 11/1925 | Jones | 132/306 |
| 1,642,780 | A | | 9/1927 | Kole et al. | |
| 1,660,347 | A | | 2/1928 | Neiman | |
| 1,794,344 | A | | 2/1931 | Soyez | |
| 1,847,948 | A | | 3/1932 | Kasdan | |
| 1,847,949 | A | | 3/1932 | Kasdan et al. | |
| 1,863,856 | A | | 6/1932 | Kasdan et al. | |
| 1,866,576 | A | | 7/1932 | Neiman | |
| 1,911,691 | A | | 5/1933 | Jacobson | |
| 1,957,650 | A | | 5/1934 | Jeffries et al. | |
| 2,140,036 | A | | 12/1938 | Morrison | |
| 2,326,839 | A | | 8/1943 | Cullen | |
| 2,460,444 | A | | 2/1949 | Bering | |
| 2,472,874 | A | | 6/1949 | Wolfers | |
| 4,488,668 | A | | 12/1984 | Flaska et al. | |
| 4,728,211 | A | | 3/1988 | Ladd, Jr. | |
| 5,383,582 | A | | 1/1995 | Baxter et al. | |
| 5,865,194 | A | * | 2/1999 | Gueret | 132/299 |
| 5,896,866 | A | * | 4/1999 | Quennessen | 132/293 |
| 6,223,787 | B1 | | 5/2001 | Graham | |
| 6,227,208 | B1 | | 5/2001 | Imbert | |
| 6,354,308 | B1 | * | 3/2002 | Kuk | 132/301 |
| 6,378,735 | B1 | | 4/2002 | Chu | |
| 6,886,719 | B1 | | 5/2005 | Shen et al. | |
| 2004/0079765 | A1 | | 4/2004 | Gallo, Jr. et al. | |

OTHER PUBLICATIONS

Photographs of a cosmetic container purchased on Feb. 7, 2007 that is being marketed by Revlon and believed to be manufactured by HCT Packaging Inc. (two images, one sheet).

* cited by examiner

*Primary Examiner*—Robyn Doan
(74) *Attorney, Agent, or Firm*—Chad D. Bruggeman; John F. Salazar; Middleton Reutlinger

(57) ABSTRACT

A cosmetic compact configured to hold a loose powder is provided. The cosmetic compact includes a base, a cover, a sifter and an applicator. The cover is coupled to the base and pivotable between an open position and a closed open position. The sifter is supported at the base to provide a chamber configured to receive the loose powder. The sifter has a platform defining at least one dispensing aperture. The applicator is compressed between the cover and the sifter when the cover is in the closed position. The compressed applicator is configured to restrict the loose powder from substantially exiting the chamber.

19 Claims, 6 Drawing Sheets

LOOSE POWDER COMPACT

BACKGROUND

The present disclosure relates generally to a compact-type container for storing and dispensing materials. The present disclosure more specifically relates to a compact for storing and dispensing a loose powder material (e.g., a cosmetic powder, etc.) or any other particulate matter.

It is generally known to provide a container for storing a loose powder. In the cosmetic industry, such known containers are often in the form of "jars" or "pots" that include a receptacle for supporting the loose powder and a cover coupled to an open end of the receptacle for sealing the receptacle. These containers often include a sifter having a pattern of openings through which the loose powder can be dispensed. The covers of such containers must be removed entirely from the receptacles before a user may access the contents of the containers (often by unscrewing the covers from the receptacles). Such known containers are typically large and clumsy thereby making them difficult or burdensome to store in relatively limited spaces (e.g., bags, purses, pockets, etc.). Further, such containers are often not designed to be carried by a user in bags, purses, pockets or the like since doing so may cause loose powder stored therein to inadvertently spread throughout the container thereby creating a mess when a user ultimately opens the container. Further still, requiring a cover to be removed entirely from the receptacle may increase the likelihood that a user may inadvertently spill loose powder while trying to open the container.

Thus there is a need for a conveniently sized container (such as a cosmetic compact) that can substantially seal off a loose powder contained therein beneath a sifter. There is also a need for a conveniently sized container suitable for storing a loose powder that does not include a cover that must be removed in order to access the loose powder. There is further a need for a container having a sifter to be capable of supporting an applicator used for applying a loose powder stored within the container. The is further a need for a container for storing a loose powder that can be moved to a latched or locked position. Accordingly, it would be desirable to provide a container capable of accomplishing any one or more of these or other needs.

SUMMARY

One exemplary embodiment relates to a cosmetic compact for holding a loose powder. The cosmetic compact includes a base, a cover, a sifter and an applicator. The cover is coupled to the base and pivotable between an open position and a closed open position. The sifter is supported at the base to provide a chamber configured to receive the loose powder. The sifter has a platform defining at least one dispensing aperture. The applicator is compressed between the cover and the sifter when the cover is in the closed position. The compressed applicator is configured to restrict the loose powder from substantially exiting the chamber.

Another exemplary embodiment relates to a cosmetic compact. The cosmetic compact includes a base, a sifter, a removable applicator and a cover. The sifter is coupled to the base and includes a flange and a platform. The flange is upwardly offset from the platform. The platform defines at least one dispensing aperture. The removable applicator is supported by the flange and sized to cover the at least one dispensing aperture. The cover is coupled to the base and movable between an open position and a closed position. The cover applies a force to the applicator in an axial direction when in the closed position to secure the applicator against the flange.

Another exemplary relates to a cosmetic compact. The cosmetic compact includes a base, a sifter, an applicator, a cover and a latch. The base contains a loose powder. The sifter is coupled to the base and has a platform positioned over the loose powder. The platform defines at least one dispensing aperture. The applicator is supported by the sifter and sized to cover the at least one dispensing aperture. The cover is coupled to the base and pivotable between an open position and a closed position. The latch is configured to releasably retain the cover in the closed position. The cover applies a force to the applicator when in the closed position to secure the applicator against the sifter.

DETAILED DESCRIPTION

Figure 1:
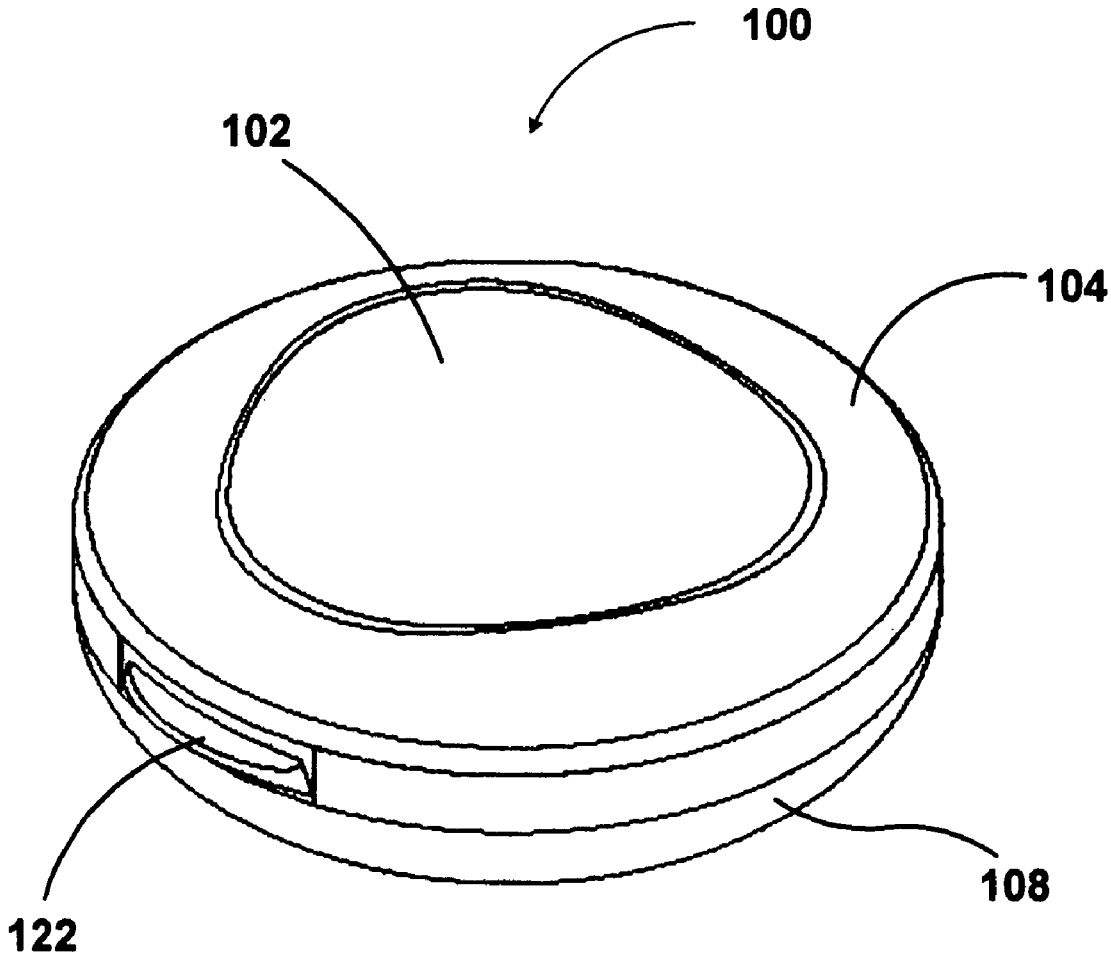
FIG. 1 is a top perspective view of a container in a closed position according to one exemplary embodiment.

Referring generally to the FIGURES, a container and components thereof are shown according to exemplary embodiments. The container, shown as a compact 100, generally comprises a first portion or cover (e.g., lid, top, etc.), shown as a closure 102, a second portion or base (e.g., bottom, pan, storage well, etc.), shown as a receptacle 108, a third portion or sifter (e.g., dispensing mechanism, shaker portion, etc.), shown as an insert 110, and a fourth portion or applicator (e.g., sponge, cloth, etc.), shown as a puff pad 124. The cover and the base cooperate to provide a conveniently sized storage system suitable for supporting the sifter and the applicator in combination with a loose powder (e.g., face powder, blush powder, etc.) or any other particulate matter or cosmetic substance.

The loose powder is stored within a cavity or chamber defined at least in part by at least one of the base and a first surface (e.g., a concealed, lower, inner surface, etc.) of the sifter. A second surface (e.g., an exposed, upper, outer surface, etc.) of the sifter is configured to support the applicator. The sifter also includes one or more dispensing openings or apertures to allow for the removal of loose powder from the chamber.

The container is configured to substantially contain the stowed loose powder within the chamber while the container is in a closed position (i.e., prevent loose powder from substantially passing through the one or more dispensing apertures in the sifter and from leaking into other areas of the container). Such a configuration allows the container to be carried by a user in a purse, bag, pocket or the like without having loose powder spread throughout the entire container. To facilitate the containment of loose powder within the chamber, a first surface (e.g., concealed, lower, inner surface, etc.) of the cover applies an axial force to a first side of the applicator as the cover is being closed relative to the base. This force is balanced by a normal force applied to an opposite side of the applicator by the sifter. The balancing of the forces secures the applicator over the one or more dispensing apertures of in the sifter (e.g., the applicator is compressed, etc.). As such, even if the) container is held upside down or at an angle, the applicator will restrict the movement of the loose powder trying to pass through the one or more dispensing apertures and enter into other parts of the container.

According to an exemplary embodiment, the second surface of the sifter (i.e., the surface that supports the applicator) is an elevated flange that is offset from a portion of the sifter that defines the one or more dispensing apertures. Such a configuration provides a slight gap between the applicator and the portion of the sifter defining the one or more dispensing apertures when the cover is in the closed position. Such a gap provides an area for a relatively small amount of the loose powder stored in the chamber to collect and become trapped adjacent to a second side of the applicator. This gap advantageously allows the loose powder to accumulate on a bottom surface of the applicator so that the applicator is ready to be used upon removal.

When a user desires to use (e.g., apply, etc.) the loose powder stowed within the container, the user selectively moves (e.g., pivots, etc.) the cover into an open position relative to the base. The user can then grasp the applicator which is likely to already have loose powder applied thereto from being adjacent to the one or more dispensing apertures, particularly if the sifter is configured to provide a gap between the applicator and the one or more dispensing apertures when the cover is in the closed position. The user may also move the applicator relative the sifter to collect additional loose powder on the applicator. According to an exemplary embodiment, the cover remains secured to the base while in the open position. For example, the container may have a clam-like configuration wherein the cover is pivotally coupled to the base about a hinge. Such a configuration advantageously allows a user to use one hand to conveniently hold and support the container in an open position and a second hand to grasp the applicator.

Figure 2:
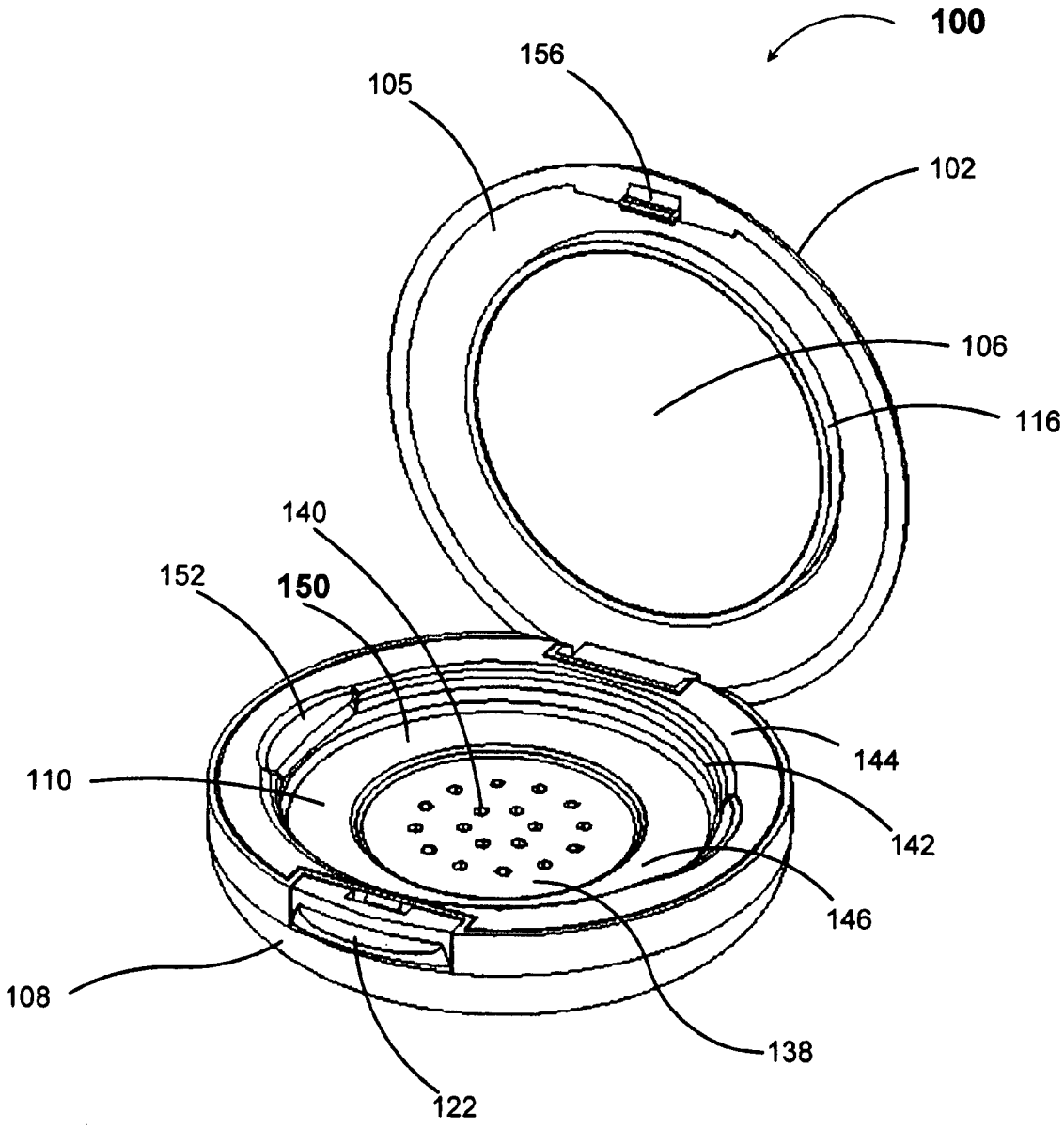
FIG. 2 is a top perspective view of the container of FIG. 1 in an open position.
Figure 3:
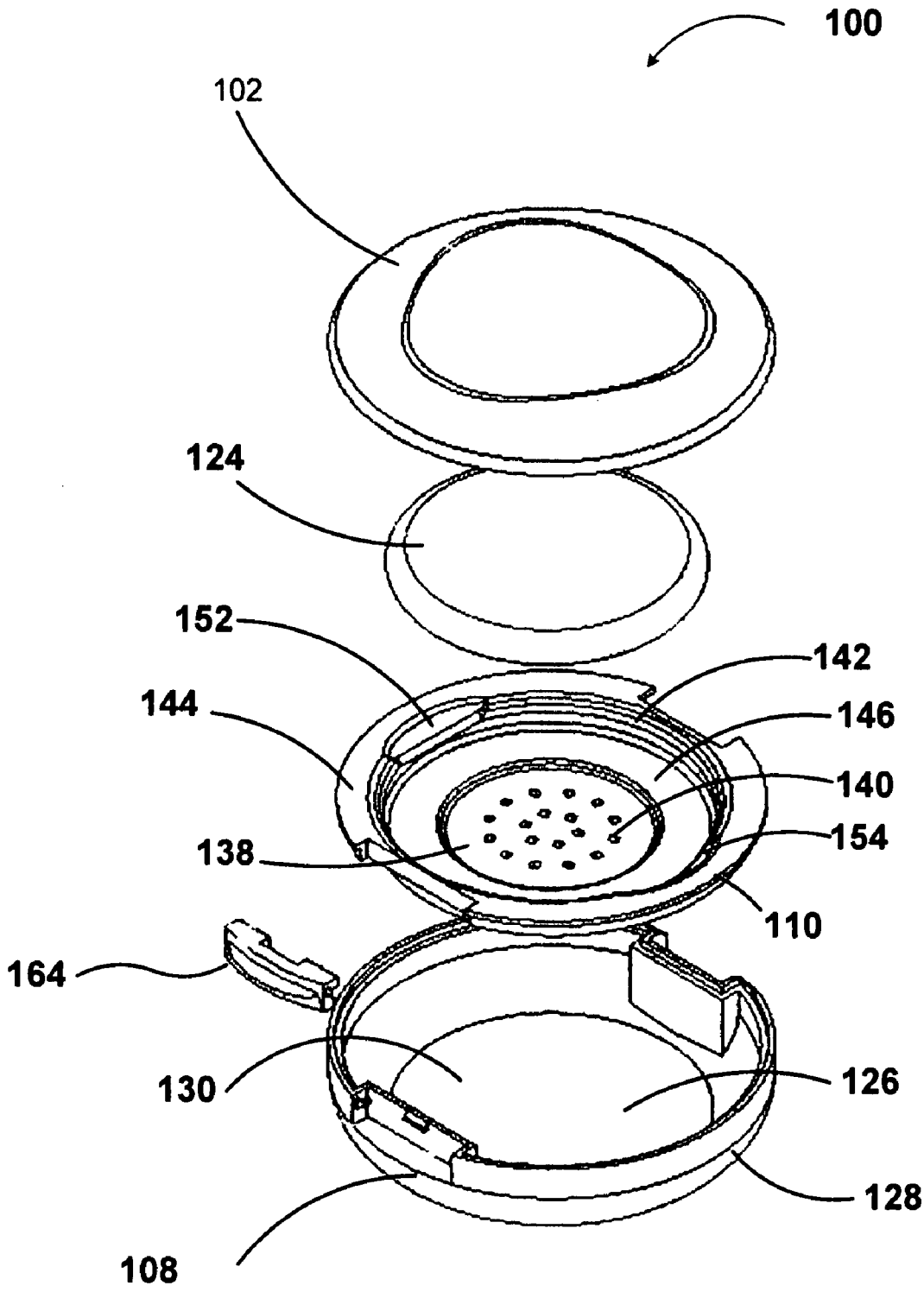
FIG. 3 is an exploded top perspective view of the container of FIG. 1.

Referring now to FIGS. 1 through 3 in particular, the cover, shown as closure 102 of compact 100, is shown according to an exemplary embodiment. Closure 102 includes an end wall (e.g., platform, top, etc.) having a first or top surface 104 (shown in FIG. 1) and a second or bottom surface 105 (shown in FIG. 2). According to the embodiment illustrated, closure 102 is substantially circular in shape with top surface 104 having a slight curvature to provide a dome-like cover (shown in FIG. 6). According to the various alternative embodiments, closure 102 may have any of a variety of shapes (e.g., rectangular, triangular, octagonal, etc.) and/or any of a variety of configurations (e.g., a substantially flat top surface, one or more side walls or skirts, etc.).

Referring to FIG. 2, a first latching element (e.g., locking structure, tab, etc.), shown as a first projection 156, is coupled to bottom surface 105 of closure 102. It should be noted that for purposes of this disclosure, the term "coupled" is used broadly to mean the joining or combining of two or more members (e.g., portions, materials, components, etc.) directly or indirectly to one another. Such joining or combining may be relatively stationary (e.g., fixed, etc.) in nature or movable (e.g., adjustable, etc.) in nature. Such joining or combining may be achieved with the two members or the two members and any additional intermediate members being integrally formed as a single unitary body with one another (e.g., one-piece, etc.) or with the two members or the two members and any additional intermediate member being attached to one another. Such joining or combining may be intended to be relatively permanent in nature or alternatively may be intended to be relatively detachable or removable in nature.

As detailed below, first projection 156 is configured to releasably engage a corresponding latching element on receptacle 108 to retain closure 102 in the closed position. According to the embodiment illustrated, first projection 156 is coupled to bottom surface 105 by being integrally formed with closure 102 as a single unitary body. According to an exemplary embodiment, closure 102 is a molded component formed with first projection 156 via a suitable molding process (e.g., injection molding, etc.). According to the various alternative embodiments, first projection 156 may be a separate component mounted to bottom surface 105. First projection 156 is further shown as having a tab or barb 158 (shown in FIG. 6) at a distal end of first projection 156. Barb 158 is provided to facilitate the engagement of first projection 156 with the corresponding latching element on receptacle 108.

Also provided at bottom surface 105 of closure 102 is a mirror 106. Mirror 106 is configured to be exposed when closure 102 is in the open position and is provided to assist a user when applying the loose powder with puff pad 124. Mirror 106 can be coupled to bottom surface 105 using any known or otherwise suitable technique including, but not limited to, an adhesive, a friction fit, an interference fit, or a welding operation. According to the embodiment illustrated, a cylindrical projection, shown as a boss 116, is designed in size and shape to accept mirror 106 in a press-fit or snap-fit manner. As detailed below, mirror 106 and/or boss 116 constitute the surfaces of closure 102 that act directly on puff pad 124 when closure 102 is in the closed position to secure puff pad 124 in its desired position (e.g., over the one or more dispensing apertures, etc.). According to the various alternative embodiments, mirror 106 may be eliminated and bottom surface 105 or some other structure may be used to provide a force to puff pad 124 when closure 102 is in the closed position.

Referring again to FIGS. 1 through 3, the base, shown as receptacle 108 of compact 100, is shown according to an exemplary embodiment. Receptacle 108 is coupled to closure 102 about a hinge 120 (shown in FIG. 6) that provides for the pivotal movement of closure 102 relative to receptacle 108 between the open position and the closed position. Hinge 120 may have any of a variety of known or otherwise suitable configurations. For example, hinge 120 may be defined by one or more pivot shafts, may be defined by a butterfly-type hinge, or may be defined by a living hinge.

Receptacle 108 is shaped and sized to correspond to closure 102. According to the embodiment illustrated, receptacle 108 has an end wall 126 (e.g., platform, bottom, bottom surface, etc.) and a side wall 128 extending upward therefrom at an orientation that is generally perpendicular to the end wall 126. Side wall 128 is generally cylindrical in shape and defines an aperture 130 (e.g., cavity, receptacle, etc.) suitable for supporting particulate matter such as a cosmetic substance, foodstuff, cleaning soaps, or any other particulate material.

The size and shape of aperture 130 may vary depending on a number of design criteria. According to an exemplary embodiment, aperture 130 has a volume between approximately 1.5 cubic inches and approximately 8 cubic inches. According to various alternative embodiments, aperture 130 may have a volume greater than or less than the range provided. Limiting the volume of aperture 130 allows the overall size of compact 100 to be minimized, thereby allowing compact 100 to be conveniently carried or stowed in relatively size restricted areas (e.g., pockets, purses, backpacks, etc.) by the user.

Figure 4:
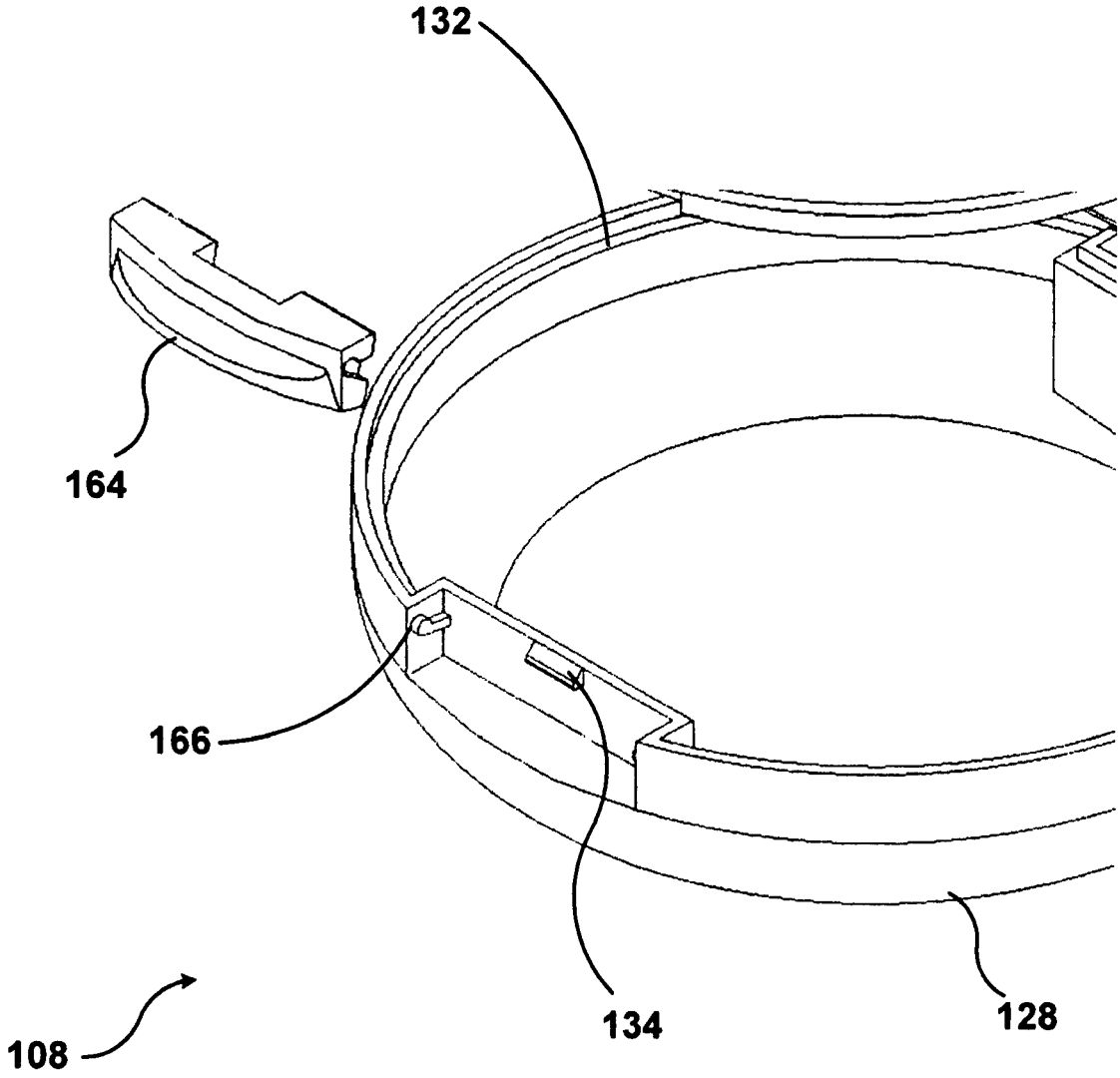
FIG. 4 is a partial exploded top perspective view of the container of FIG. 1 showing the detail of a latch according to an exemplary embodiment.
Figure 5:
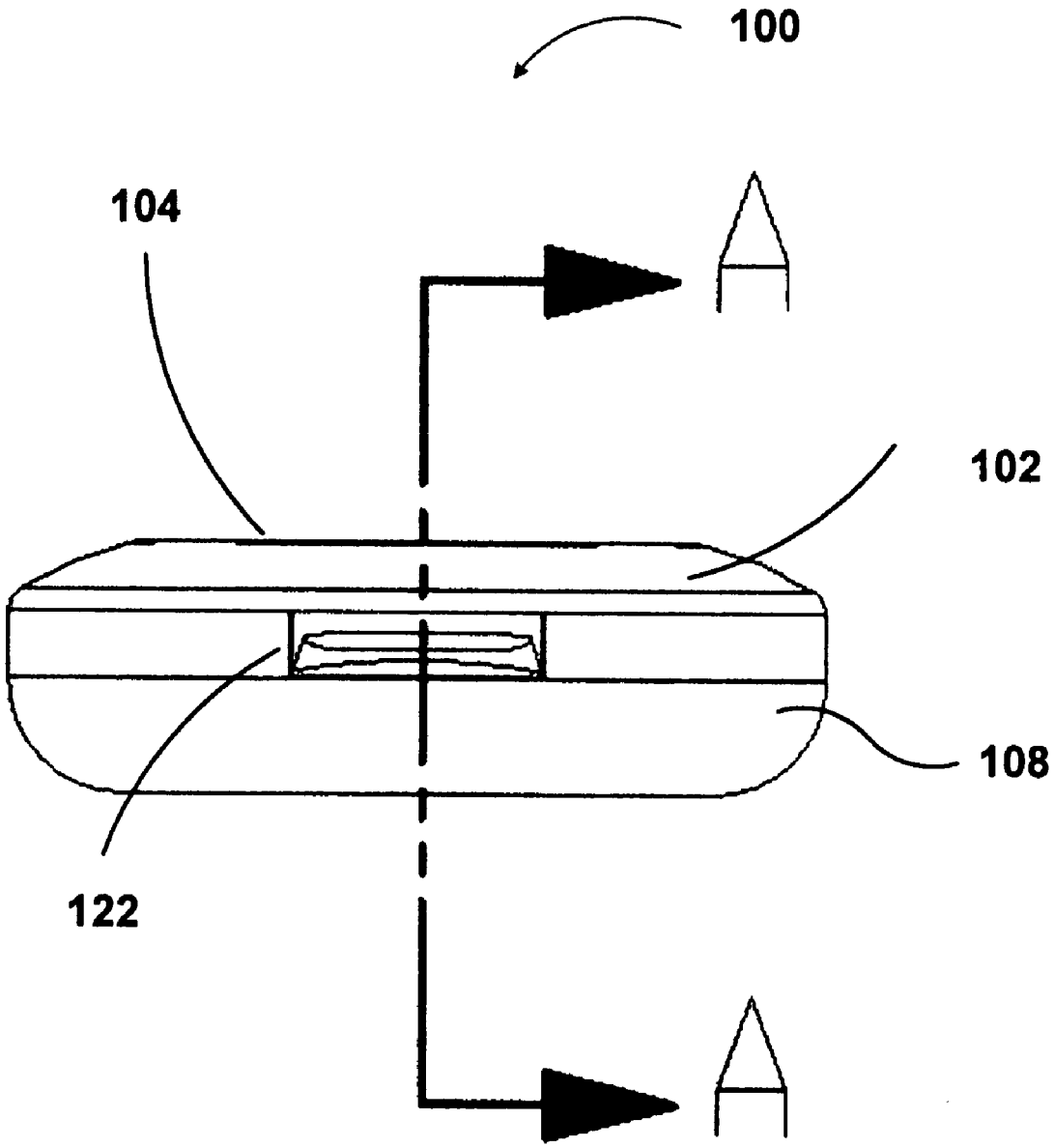
FIG. 5 is a side plan view of the container of FIG. 1.

Referring to FIG. 4, receptacle 108 also includes a support structure, shown as a ledge 132, located adjacent to side wall 128 and somewhat lowered or recessed from a top edge of side wall 128. Ledge 132 is configured to support insert 110 and is shown as extending substantially around the circumference of receptacle 108. According to an exemplary embodiment, insert 110 is fixedly coupled to ledge 132. According to the various alternative embodiments, insert 110 may be detachably coupled to ledge 132 so that compact 100 can be readily refilled with loose powder by a user when compact 100 is depleted of the loose powder.

Receptacle 108 further includes a second latching element (e.g., locking structure, tab, etc.), shown as a second projection 134. Second projection 134 is shown as being coupled to an outer surface of side wall 128 in a cutout or notched area of side wall 128 that is configured to receive a third portion of a latch 122 which is detailed below. Second projection 134 is configured to releasably engage first projection 156. Similar to first projection 156, second projection 134 is integrally formed with receptacle 108 to provide a single one-piece unitary body. Second projection 134 also includes tab, shown as a second barb 136 in FIG. 6, at a distal end of second projection 134. As closure 102 is moved into the closed position, a camming or guide surface on first barb 158 of first projection 156 engages a camming or guide surface on second barb 136 to urge first barb 158 over second barb 136. Once first barb 158 passes over second barb 136, an interference fit is provide between first projection 156 and second projection 134 to retain closure 102 in the closed position until a user selectively actuates latch 122.

Referring back to FIGS. 2 and 3, the sifter, shown as insert 110, is shown according to an exemplary embodiment. Insert 110 includes a platform 138 defining one or more dispensing apertures 140. Insert 110 is configured to control (via the one or more dispensing apertures 140) how the loose powder stored within receptacle 108 is dispensed from compact 100. Insert 110 may control the direction and/or pattern in which the loose powder is dispensed from compact 100. Further still, insert 110 may control the amount of loose powder that is dispensed from compact 100 (i.e., flow rate).

Insert 110 is shown as being received by receptacle 108. In particular, insert 110 is shown as being situated on top of receptacle 108. Further still, insert 110 is shown as being supported by ledge 132 of receptacle 108 to at least partially define a chamber or cavity 160 (shown in FIG. 6) configured to receive the loose powder. According to an exemplary embodiment, insert 110 includes a side wall 142, a first flange 144 and a second flange 146. Side wall 142 defines a recess 150 configured to receive puff pad 124. Side wall 142 is sized so that the outer periphery of puff pad 124 is substantially close to side wall 142.

To assist a user when trying to remove puff pad 124 from recess 150, insert 110 further includes one or more notches or cutouts, shown as a first indentation 152 and a second indentation 154. First indentation 152 and second indentation 154 are of a size and shape to readily accommodate a user's fingers and provide a clearance for ease in removing puff pad 124 from recess 150. According to the embodiment illustrated, first indentation 152 and second indentation 154 are provided at opposite lateral sides of insert 110. According to the various alternative embodiments, any number of cuts or indentations may be provided, in any of a variety of positions, to assist a user in removing puff pad 124 from recess 150.

Referring to FIG. 3, first flange 144 is provided at an upper end of side wall 142 and is the structure that functions as the interface between insert 110 and receptacle 108. Second flange 146 is provided a lower end of side wall 142 and is the structure that supports puff pad 124 when inserted into recess 150. According to an exemplary embodiment, both first flange 144 and second flange 146 are substantially parallel with platform 138.

According to an exemplary embodiment, platform 138 of insert 110 is a recessed or lowered relative to second flange 146. As stated above, platform 138 is the portion of insert 110 that defines the one or more dispensing apertures 140. Dispensing apertures 140 are of appropriate size, number, and pattern for dispensing a desired amount of the loose powder onto puff pad 124. According to the embodiment illustrated, platform 138 defines eighteen dispensing apertures 140, each having a generally circular cross section. According to the various exemplary embodiments, any number of dispensing apertures 140 may be provided, having any of a number of shapes and/or sizes. For example, dispensing apertures 140 may be provided as a single S-shaped aperture or a plurality of apertures of varying sizes.

Figure 6:
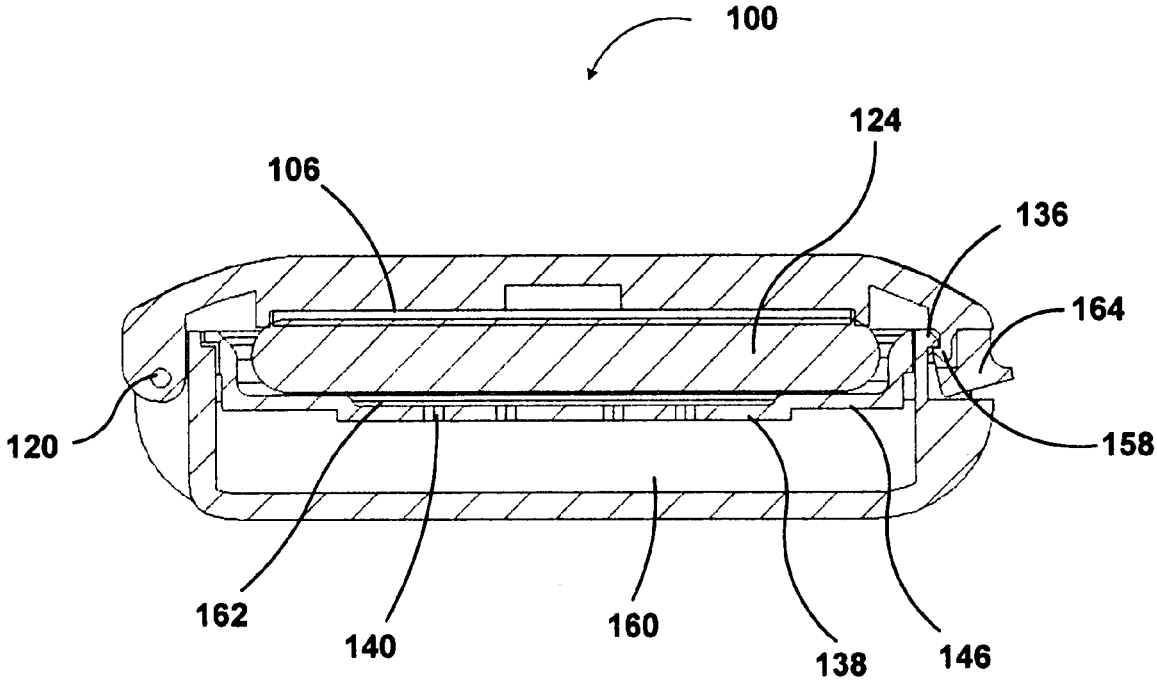
FIG. 6 is a cross-sectional view of the container of FIG. 1 along a line A-A of FIG. 5.

By lowering platform 138 relative to second flange 146, a recess or gap 162 is created between platform 138 and puff pad 124 when closure 102 is in the closed position (see FIG. 6). The space provided by gap 162 is configured to receive a relatively small amount of the loose powder in cavity 160 when closure 102 is in the closed position. As such, a bottom surface of puff pad 124 is exposed to the loose powder so that when a user selectively removes puff pad 124 from recess 150, puff pad 124 has the loose powder applied thereto.

According to the various alternative embodiments, platform 138 may be substantially aligned with second flange 146 to provide a relatively flat surface. The transition between platform 138 and second flange 146 may be substantially continuous or may be interrupted by one or more projections or recesses. In such embodiments, gap 162 would not be present when closure 102 is in the closed position. It should also be noted that insert 110, with platform 138 recessed relative to second flange 146, may also be suitable for use with containers or compacts wherein the cover is removed from the base upon opening (e.g., screw-on type covers, etc.).

Referring to FIGS. 3 and 6, the applicator, shown as puff pad 124, is shown according to an exemplary embodiment. Puff pad 124 provided in combination with the other components of compact 100 for the purpose of providing a user with a tool that the user can use when applying the loose powder stored within compact 100. When not in use, puff pad 124 is stored above platform 138 of insert 110 by being supported by second flange 146. According to the embodiment illustrated, puff pad 124 has a size and shape and of similar dimensions as mirror 106 (i.e., puff pad 124 is a substantially circular-shaped applicator). According to an exemplary embodiment, puff pad 124 is constructed of any suitable material that substantially maintains its shape when enclosed in compact 100 and will provide an appropriate medium for delivering the loose powder to its intended application (e.g., the face of a user, etc.). According to the various alternative embodiments, puff pad 124 may be formed of a relatively complaint material that substantially conforms to the shape of insert 110 or any other structure upon which it is supported (e.g., a cloth, etc.).

Referring to FIGS. 2 through 4, latch 122 is shown according to an exemplary embodiment. Latch 122 generally includes first projection 156, second projection 134 and an actuation device, shown as a button 164. First projection 156 and second projection 134 are configured to releasably engage each other and were detailed above. Button 164 is provided so that a user may readily disengage first projection 156 from second projection 134. According to the embodiment illustrated, button 164 is provided at a front portion of compact 100 and is movably supported on a pair of rocker projections 166 coupled to receptacle 108. The opening of compact 100 occurs by a user applying pressure to button 164, thereby creating a rocking motion that pulls barb 158 of first projection 156 away from barb 136 of second latch 134 and releases closure 102 from receptacle 108.

The operation of compact 100 by a user is now discussed with reference to FIGURES. Compact 1100 remains in the closed position (shown in FIG. 1) when not in use. In this closed state, the user may choose to place compact 100 and its sealed contents of loose powder in a purse, bag, pocket, etc. for use at various times when away from a stationary cosmetic application location. As compact 100 and its contents move around in a purse, bag, or pocket, etc., a relatively small amount of the loose powder stored in cavity 160 is able to enter or sift into gap 162 defined by puff pad 124, side wall 128 and platform 138.

The size and placement of puff pad 124 placed over dispensing apertures 140 provides a seal and prevents the loose powder from leaking from recess 160 into other areas of compact 100 when closure 102 is in the closed position. The location of mirror 106, mounted to closure 102, places mirror 106 at a height that allows pressure to be applied by mirror 106 onto puff pad 124 and holds puff pad 124 in position when compact 100 is in the closed position. Other than being allowed to enter gap 162, the loose powder remains in recess 160 until the next use. As such, the loose powder will not spill out all over the inside of compact 100 when being carried by the user.

When the user desires to access the contents of compact 100, the user actuates latch 122 (e.g., via the pressing of button 164, etc.) to release closure 102 from receptacle 108 and pivots closure 102 into the open position (shown in FIG. 2). In the open position, platform 138 releases the loose powder from cavity 160 to gap 162 by the arrangement of dispensing apertures 140 defined by platform 138 of insert 110. The user may then pick up puff pad 124 by placing fingers in first indentation 152 and second indentation 154 and then use puff pad 124 to gather the loose powder contained within gap 162 and apply as desired. Once finished, the user may return compact 100 to the closed position by placing puff pad 124 into recess 150 (e.g., on top of second flange 146 and over dispensing apertures 140, etc.) and close closure 102 relative to receptacle 108 until first projection 156 engages second projection 134 to retain closure 102 in the closed position.

It is important to note that the construction and arrangement of the elements of the compact as shown in the exemplary embodiment are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Further, the compact may be configured in a wide variety of shapes to accommodate varying design criteria. According to an exemplary embodiment, the compact has an overall height between approximately 0.5 inches and approximately 2 inches. For such an embodiment, the compact may have an width (e.g., diameter, etc.) between approximately 2 inches and approximately 3 inches. Limiting the size of the compact to such dimensions allows the compact to be conveniently carried and/or stowed by the user. According to the various alternative embodiments, the compact may be configured into other sizes, as well as other well-known or otherwise suitable shapes having linear and/or nonlinear edges and surfaces. For example, the compact may be a generally rectangular or octagonal container. Further, for purposes of this disclosure the term "particulate matter" is used broadly to refer to any particulate substance (e.g., powder-like substances, granular substances, or the like, etc.) including cosmetic substances, food substances, cleaning soaps, medical substances, etc. According to various other exemplary embodiments, the compact may be configured to support a fluid.

Accordingly, all such modifications are intended to be included within the scope of the appended claims. The order or sequence of any process or method steps may be varied or re-sequenced according to alternative embodiments. Other substitutions, modifications, changes and omissions may be made in the design, operating conditions and arrangement of the various exemplary, embodiments without departing from the scope of the appended claims.

What is claimed is:

1. A cosmetic compact for holding a loose powder, said cosmetic compact comprising:

a base;

a cover coupled to said base and pivotable between an open position and a closed open position;

a sifter supported at said base to provide a chamber configured to receive the loose powder, said sifter including a first flange, a second flange, a platform, said platform at a first elevation and defining at least one dispensing aperture, said second flange at a second elevation, wherein said second elevation is upwardly offset from said first elevation, a downwardly depending annular skirt interposed between said platform and said second flange creating a gap, said first flange at a third elevation, wherein said third elevation is upwardly offset from said second elevation, a downwardly depending annular side wall interposed between said first flange and said second flange creating a recess, wherein said recess is disposed over said gap; and an applicator received within said recess and compressed between said cover and said second flange of said sifter when said cover is in said closed position, wherein said compressed applicator is configured to restrict the loose powder from substantially exiting said chamber.

2. The cosmetic compact of claim 1, wherein said platform, said first flange, and said second flange are substantially parallel to each other.

3. The cosmetic compact of claim 1, wherein said first flange and said side wall define at least one indentation configured to receive a finger of a user when removing said applicator from said recess.

4. The cosmetic compact of claim 3, wherein said at least one indentation includes a first indentation and a second indentation, said first indentation being positioned on a side of said cosmetic compact that is substantially opposite said second indentation.

5. The cosmetic compact of claim 1, wherein said base includes a side wall and a ledge, said ledge located adjacent to an inner surface of said base side wall, said ledge being downwardly offset from an upper surface of said base side wall and configured to receive said sifter first flange.

6. The cosmetic compact of claim 5, wherein said upper surface of said base side wall is coplanar with said sifter first flange.

7. The cosmetic compact of claim 1, wherein said recess is sized so that an outermost periphery of said applicator is closely adjacent to said side wall of said sifter.

8. The cosmetic compact of claim 1, wherein said gap between said applicator and said platform is configured to receive the loose powder.

9. The cosmetic compact of claim 1, further including a latch for retaining said cover in said closed position, said latch having a first projection coupled to said base and a second projection coupled to said cover, said first projection is configured to at least partially interfere with said second projection when said cover is in said closed position.

10. The cosmetic compact of claim 1, wherein said base and said cover are substantially circular in shape.

11. The cosmetic compact of claim 1, wherein said at least one dispensing aperture includes a plurality of dispensing apertures arranged in a pattern.

12. The cosmetic compact of claim 1, further including a mirror coupled to said cover.

13. The cosmetic compact of claim 12, wherein said mirror compresses said applicator when said cover is in said closed position.

14. A cosmetic compact comprising:

a base having a bottom wall with an upwardly extending annular skirt defining an opening;

a sifter disposed over said base opening and coupled to said base, said sifter including a first flange at a third elevation, a second flange at a second elevation, and a platform at a first elevation, said platform defining at least one dispensing aperture, said second flange at said second elevation being upwardly offset from said platform at said first elevation, a downwardly depending annular skirt interposed between said platform and said second flange creating a gap, and said first flange at said third elevation being upwardly offset from said second flange at said second elevation, and a downwardly depending annular side wall interposed between said first flange and said second flange creating a recess, wherein said recess is disposed over said gap;

a removable applicator supported by said second flange at said second elevation and sized to cover said at least one dispensing aperture of said platform;

a cover coupled to said base and movable between an open position and a closed position, said cover having a bottom surface that supports a mirror; and wherein said mirror applies a force to said applicator in an axial direction when in said closed position to secure said applicator against said second flange.

15. The cosmetic compact of claim 14, wherein said side wall includes at least one indentation configured to receive a finger of a user when removing said applicator.

16. A cosmetic compact comprising:

a base containing a loose powder;

a sifter coupled to said base, said sifter comprising a first flange, a second flange, and a platform formed as a unitary body, said platform at a first elevation and being positioned over the loose powder of said base and defining at least one dispensing aperture, said second flange at a second elevation and being upwardly offset from said platform at said first elevation, a downwardly depending annular skirt interposed between said platform and said second flange creating a gap, said first flange at a third elevation and being upwardly offset from said second flange at said second elevation; and a downwardly depending annular side wall interposed between said first flange and said second flange creating a recess, wherein said recess is disposed over said gap, an applicator supported by said second flange and sized to cover said at least one dispensing aperture;

a cover coupled to said base and pivotable between an open position and a closed position; and a latch configured to releasably retain said cover to said base when in said closed position, wherein said cover applies a force to said applicator when in said closed position to secure said applicator against said second flange.

17. The cosmetic compact of claim 16, wherein said latch includes:

a first latching element coupled to said base; and a second latching element coupled to said cover, wherein said first latching element and said second latching element are projections configured to engage each other to releasably retain said cover to said base in said closed position.

18. The cosmetic compact of claim 17, further including a third latching element actuatable by a user, wherein said third latching element being a push button movably supported at said base and configured to pull said first latching element away from said second latching element to disengage said first latching element from said second latching element when actuated by the user.

19. The cosmetic compact of claim 18, wherein said push button is movably supported by a pair of projections extending from said base, said projections allow said push button to move in a rocking motion when actuated by a user, said rocking motion enables said push button to disengage said first latching element from said second latching element.

* * * * *

UNITED STATES PATENT AND TRADEMARK OFFICE

CERTIFICATE OF CORRECTION

PATENT NO. : 7,841,349 B2
APPLICATION NO. : 11/705554
DATED : November 30, 2010
INVENTOR(S) : Kyle M. Bennett It is certified that error appears in the above-identified patent and that said Letters Patent is hereby corrected as shown below:

Title Page, item 57 ABSTRACT, Line 4: delete “open” after “closed”
Column 1, Line 39: replace “The is” with --There is--
Column 2, Line 3: insert --embodiment-- after “exemplary”
Column 3, Line 3: delete “in” after “of”
Column 3, Line 4: replace “the)” with --the--
Column 5, Line 21: insert --a-- after “includes”
Column 5, Line 67: insert --at-- after “provided”
Column 6, Line 6: delete “a” after “is”
Column 6, Line 41: insert --is-- after “Puff pad 124”
Column 6, Line 55: replace “complaint” with --compliant--
Column 7, Line 8: replace “1100” with --100--
Column 7, Line 20: replace “recess” with --cavity--
Column 7, Line 26: replace “recess” with --cavity--
Column 7, Line 67: replace “an” with --a--

Signed and Sealed this
Tenth Day of April, 2012

David J. Kappos

David J. Kappos
*Director of the United States Patent and Trademark Office*